US008740051B2

(12) United States Patent
Gonzalez

(10) Patent No.: US 8,740,051 B2
(45) Date of Patent: Jun. 3, 2014

(54) CARTON WITH HANDLE

(75) Inventor: Ana Gonzalez, Barcelona (ES)

(73) Assignee: Graphic Packaging International, Inc., Marietta, GA (US)

( * ) Notice: Subject to any disclaimer, the term of this patent is extended or adjusted under 35 U.S.C. 154(b) by 365 days.

(21) Appl. No.: 13/182,668

(22) Filed: Jul. 14, 2011

(65) Prior Publication Data

US 2012/0012600 A1 Jan. 19, 2012

Related U.S. Application Data

(60) Provisional application No. 61/399,625, filed on Jul. 15, 2010, provisional application No. 61/399,852, filed on Jul. 19, 2010.

(51) Int. Cl.
*B65D 5/462* (2006.01)

(52) U.S. Cl.
USPC ..... 229/117.14; 229/117.12; 229/117.13; 229/117.22

(58) Field of Classification Search
USPC ..... 229/117.12, 117.13, 117.14, 117.15, 229/117.22, 117.23, 117.24, 117.26; 206/427
See application file for complete search history.

(56) References Cited

U.S. PATENT DOCUMENTS

| | | | |
|---|---|---|---|
| 2,681,143 | A | 6/1954 | Guyer |
| 2,842,304 | A | 7/1958 | Ringler |
| 2,955,739 | A | 10/1960 | Collura |
| 3,076,591 | A | 2/1963 | Nute et al. |
| 3,300,119 | A | 1/1967 | Chaussadas |
| 3,904,036 | A | 9/1975 | Forrer |
| 4,378,905 | A | 4/1983 | Roccaforte |
| 4,470,503 | A | 9/1984 | Stone |
| 4,482,090 | A | 11/1984 | Milliens |
| 4,498,619 | A | 2/1985 | Roccaforte |
| 4,546,914 | A | 10/1985 | Roccaforte |
| 4,588,084 | A | 5/1986 | Holley, Jr. |
| 4,747,534 | A | 5/1988 | Marie |

(Continued)

FOREIGN PATENT DOCUMENTS

| | | |
|---|---|---|
| CA | 1 243 987 | 11/1988 |
| EP | 0 754 631 A1 | 1/1997 |

(Continued)

OTHER PUBLICATIONS

International Search Report and Written Opinion of the International Searching Authority for corresponding International Application No. PCT/US2011/043948.

*Primary Examiner* — Gary Elkins
(74) *Attorney, Agent, or Firm* — Womble Carlyle Sandridge & Rice, LLP

(57) ABSTRACT

A carton for containing a plurality of articles. The carton can comprise a plurality of panels that extends at least partially around an interior of the carton. The plurality of panels can comprise an inner top panel and an outer top panel that at least partially overlaps the inner top panel. An outer end flap can be foldably connected to the outer top panel at an upper corner of the carton, and the outer end flap can at least partially close an end of the carton. A handle can comprise a handle panel defined in at least the inner top panel and a handle flap defined in the outer end flap. The handle panel can be mounted to the handle flap so that a portion of the handle panel is covered by the upper corner.

27 Claims, 10 Drawing Sheets

(56) References Cited

U.S. PATENT DOCUMENTS

| | | | | |
|---|---|---|---|---|
| 5,197,598 | A | 3/1993 | Stout et al. | |
| 5,328,081 | A | 7/1994 | Saulas | |
| 5,385,234 | A | 1/1995 | Stout et al. | |
| 5,482,203 | A | 1/1996 | Stout | |
| 5,639,017 | A | 6/1997 | Fogle | |
| 6,065,590 | A | 5/2000 | Spivey | |
| 6,131,803 | A | 10/2000 | Oliff et al. | |
| 6,899,221 | B2 * | 5/2005 | Skolik et al. | 206/427 |
| 6,905,066 | B2 * | 6/2005 | Holley et al. | 229/117.13 |
| 6,926,193 | B2 | 8/2005 | Smalley | |
| 2001/0017314 | A1 | 8/2001 | Boukredine et al. | |
| 2003/0015579 | A1 * | 1/2003 | LeBras et al. | 229/117.22 |
| 2005/0247767 | A1 * | 11/2005 | Smalley | 229/117.13 |
| 2007/0181658 | A1 * | 8/2007 | Sutherland | 229/117.12 |
| 2008/0048014 | A1 * | 2/2008 | Bates | 229/117.13 |
| 2008/0099544 | A1 * | 5/2008 | Skolik | 229/117.13 |

FOREIGN PATENT DOCUMENTS

| | | |
|---|---|---|
| FR | 2 481 231 | 10/1981 |
| GB | 2 206 565 A | 1/1989 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/27538 | 9/1996 |
| WO | WO 97/44253 | 11/1997 |
| WO | WO 00/20288 | 4/2000 |
| WO | WO 02/36440 | 5/2002 |
| WO | WO 2006/084009 | 8/2006 |

* cited by examiner

CARTON WITH HANDLE

CROSS-REFERENCE TO RELATED APPLICATIONS

This application claims the benefit of U.S. Provisional Patent Application No. 61/399,625, filed Jul. 15, 2010, and U.S. Provisional Patent Application No. 61/399,852, filed Jul. 19, 2010.

INCORPORATION BY REFERENCE

The disclosures of U.S. Provisional Patent Application No. 61/399,625, which was filed on Jul. 15, 2010, and U.S. Provisional Patent Application No. 61/399,852, which was filed on Jul. 19, 2010, are hereby incorporated by reference for all purposes as if presented herein in their entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton can comprise a plurality of panels that extends at least partially around an interior of the carton. The plurality of panels can comprise an inner top panel and an outer top panel that at least partially overlaps the inner top panel. An outer end flap can be foldably connected to the outer top panel at an upper corner of the carton, and the outer end flap can at least partially close an end of the carton. A handle can comprise a handle panel defined in at least the inner top panel and a handle flap defined in the outer end flap. The handle panel can be mounted to the handle flap so that a portion of the handle panel is covered by the upper corner.

In another aspect, the disclosure is generally directed to a carton for containing a plurality of articles. The carton can comprise a plurality of panels that extends at least partially around an interior of the carton. The plurality of panels can comprise a top panel, at least a portion of the top panel defining at least a portion of a top wall of the carton. An end flap can be foldably connected to at least one panel of the plurality of panels, with the end flap at least partially closing an end of the carton. A handle can comprise a handle panel extending in at least the top panel and a handle flap extending in at least the end flap. The handle panel can be mounted to the handle flap, and the handle flap can be circumscribed by a remainder of the end flap and spaced apart from the top wall of the carton.

In another aspect, the disclosure is generally directed to a blank for forming a carton for containing a plurality of articles. The blank can comprise a plurality of panels comprising a top panel, an end flap foldably connected to at least one panel of the plurality of panels, and handle features comprising a handle panel extending in at least the top panel and a handle flap extending in the end flap. The handle panel can comprise a central portion and an end portion foldably connected to the central portion, and the handle flap can be circumscribed by a remainder of the end flap and spaced apart from the plurality of panels.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons for containing articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass, plastic, or metal beverage bottles) as disposed within the carton embodiments. In this specification, the terms "lower," "bottom," "upper" and "top" indicate orientations determined in relation to fully erected and upright cartons.

Figure 1:
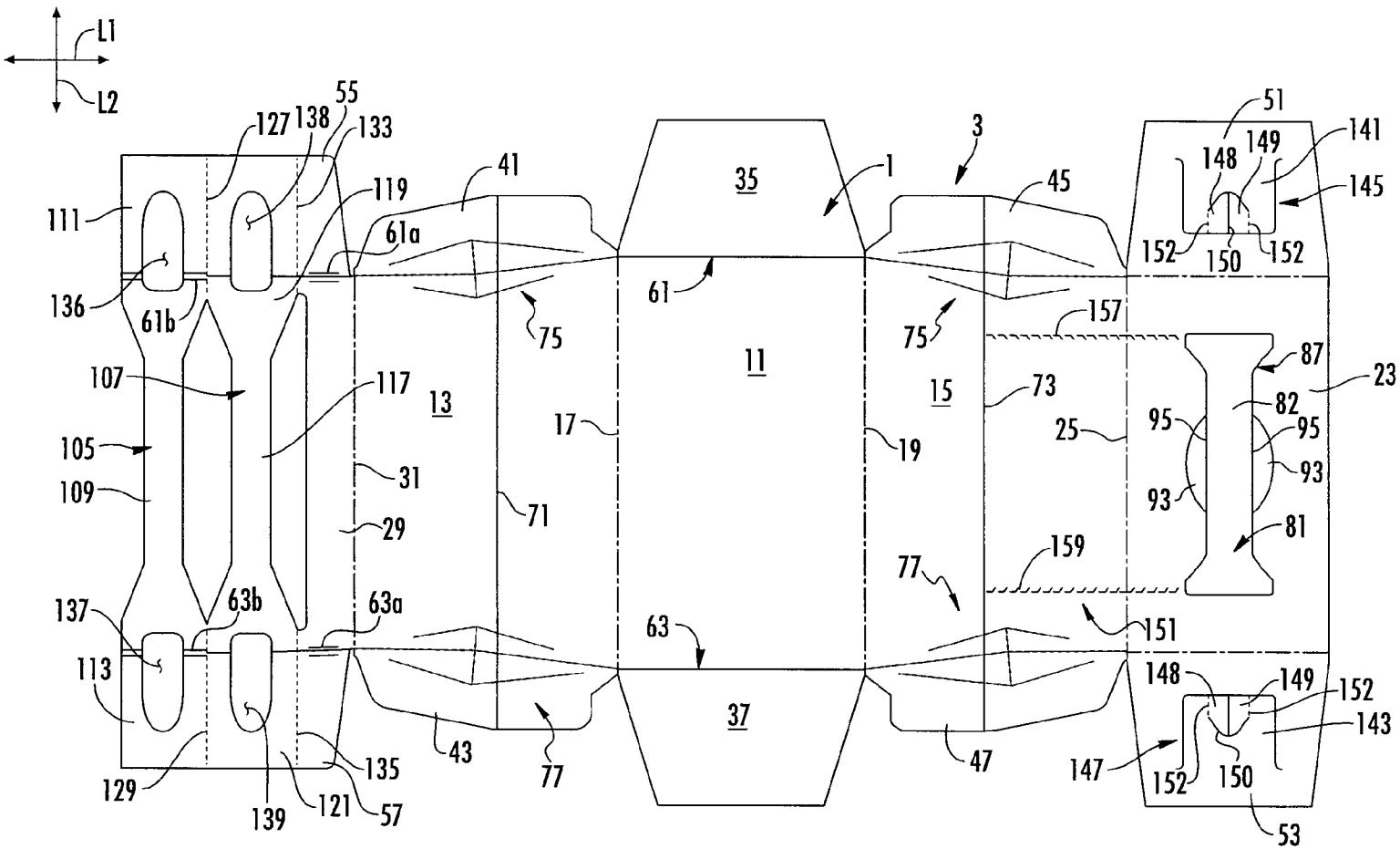
FIG. 1 is an exterior plan view of a blank for forming a carton according to a first embodiment of the disclosure.

FIG. 1 is a plan view of the exterior side 1 of a blank, generally indicated at 3, used to form a carton 5 (FIG. 5) according to an exemplary embodiment of the disclosure. The carton 5 can be used to house a plurality of articles such as containers C (FIG. 7). The carton 5 has a handle, generally indicated at 7 (FIGS. 5-7), for grasping and carrying the carton. In the illustrated embodiment, the carton 5 is sized to house twelve containers C in a single layer in a 3×4 arrangement, but it is understood that the carton may be sized and shaped to hold containers of a different or same quantity in more than one layer and/or in different row/column arrangements (e.g., 1×6, 3×6, 2×6, 4×6, 2×6×2, 3×4×2, 2×9, etc.). In the illustrated embodiment, the containers C are bottles, but other types of containers can be used in the carton 5.

Figure 4:
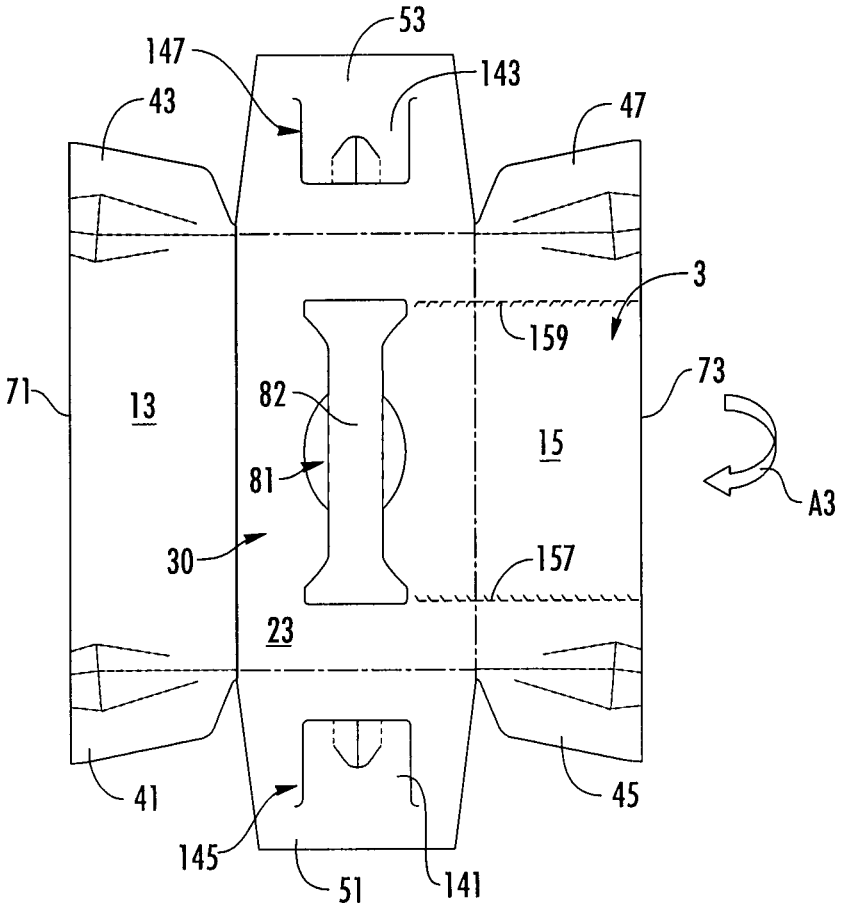
Figure 5:
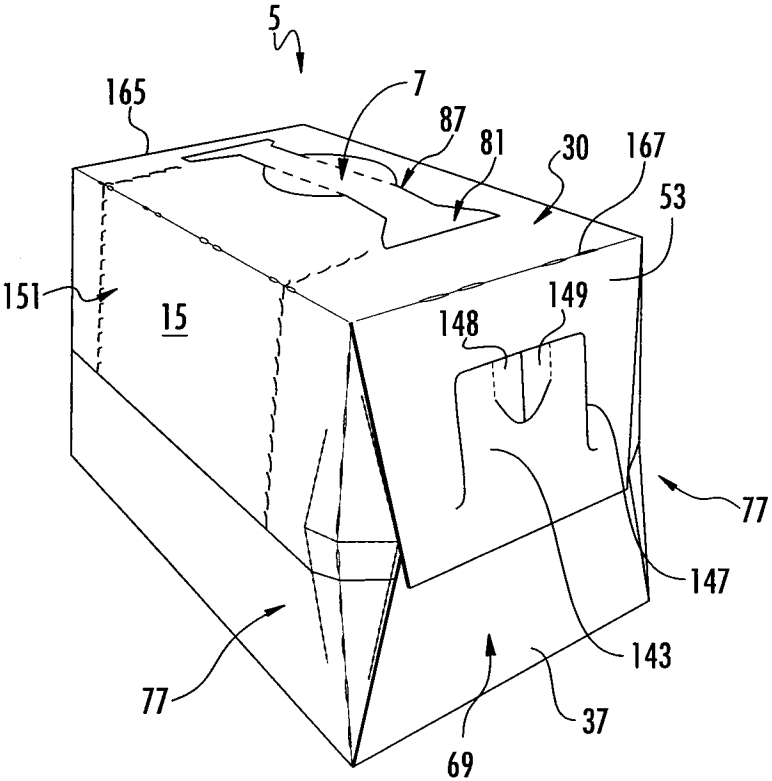
FIG. 5 is a perspective view of the carton according to the first embodiment of the disclosure.

The blank 3 has a longitudinal axis L1 and a lateral axis L2. The blank 3 comprises a bottom panel 11 foldably connected to first and second side panels 13, 15 at lateral fold lines 17, 19, an outer top panel 23 foldably connected to the second side panel 15 at a lateral fold line 25, and an inner top panel 29 foldably connected to the first side panel 13 at a lateral fold line 31. The outer and inner top panels 23, 29 can at least partially overlap in the erected carton 5 to form a top wall 30 (FIGS. 4 and 5).

The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The outer top panel 23 is foldably connected to a first top end flap 51 and a second top end flap 53. The inner top panel 29 is foldably connected to a third top end flap 55 and a fourth top end flap 57.

The end flaps 35, 41, 45, 51, 55 extend along a first marginal area of the blank 3, and are foldably connected at a first longitudinal fold line 61 that extends along the length of the blank. The end flaps 37, 43, 47, 53, 57 extend along a second marginal area of the blank 3, and are foldably connected at a second longitudinal fold line 63 that also extends along the length of the blank. The longitudinal fold lines 61, 63 may be, for example, substantially straight, or oblique at one or more locations to account for blank thickness or for other factors. Additionally, portions of the longitudinal fold lines 61, 63 can be weakened areas, such as portions of the longitudinal fold lines 61, 63 that are overlapped by respective other portions of the longitudinal fold lines 61, 63. A weakened area can be two or more scores, creases, or other lines. For example, weakened areas 61*a*, 61*b* can be generally aligned with the first longitudinal fold line 61 and weakened areas 63*a*, 63*b* can be generally aligned with the second longitudinal fold line 63. When the carton 5 is erected, the end flaps 35, 41, 45, 51, 55 close a first end 67 of the carton, and the end flaps 37, 43, 47, 53, 57 close a second end 69 of the carton. In accordance with an alternative embodiment of the disclosure, different flap arrangements can be used for closing the ends 67, 69 of the carton 5.

In the illustrated embodiment, the blank 3 includes a lateral fold line 71 extending across the side end flap 41, the first side panel 13, and the side end flap 43. Also, a lateral fold line 73 extends across the side end flap 45, the second side panel 15, and the side end flap 47. The lateral fold lines 71, 73 allow the side panels 13, 15 and the ends 67, 69 to taper inwardly from at least the respective fold lines 71, 73 to the top wall 30 of the carton 5. The blank 3 also can include two diamond-shaped corners, generally indicated at 75, at the first end 67 of the carton 5 and two diamond-shaped corners 77 at the second end 69 of the carton. The diamond corners 75, 77 can help the carton 5 at least partially conform to the shape of the containers C in the corners of the carton. The top panel 23 can be shorter than the bottom panel 15 in the lateral direction L2 so that some or all of each end of the carton can be angled inwardly. The fold lines 71, 73 and diamond corners 75, 77 can be otherwise shaped or positioned, or can be omitted, without departing from the disclosure.

The features that comprise the handle 7 can include an outer handle panel 81 that is in the outer top panel 23. The outer handle panel 81 comprises a central portion 82 in the top panel 23. In the illustrated embodiment, the central portion 82 of the handle panel 81 includes two handle flaps 93 foldably connected to the handle panel at respective lateral fold lines 95. As shown in FIG. 1, the ends of the outer handle panel 81 are flanged or widened with respect to the central portion 82. The periphery of the outer handle panel 81 is typically defined by a tear line 87 in the top panel 23, so that the outer handle panel 81 is detachable.

The features that comprise the handle 7 also can comprise an inner handle panel 105 in the inner top panel 29 and the top end flaps 55, 57, and an intermediate handle panel 107 in the inner top panel and top end flaps. The inner handle panel 105 has a central portion 109 in the inner top panel 29 and end portions 111, 113 in a respective top end flap 55, 57. Similarly, the intermediate handle panel 107 has a central portion 117 in the inner top panel 29 and end portions 119, 121 in a respective top end flap 55, 57. In the illustrated embodiment, the central portions 109, 117 can be generally narrower than the respective end portions 111, 113 and 119, 121, and the narrowness can be provided as a result of portions of the inner top panel 29 having been cut out/removed. The inner handle panel 105 is foldably connected to the intermediate handle panel 107 at respective lateral fold lines 127, 129 that extend from the inner top panel 29 into respective end flaps 55, 57. The intermediate handle panel 107 is detachably connected to the inner top panel 29 and top end flaps 55, 57 at respective lateral tear lines 133, 135 that extend from the inner top panel 29 into respective end flaps 55, 57. Article-receiving features of the handle 7 include respective openings 136, 137 at respective end portions 111, 113 of the inner handle panel 105 and openings 138, 139 at respective end portions 119, 121 of the intermediate handle panel 107.

In the illustrated embodiment, the features that are for forming the handle 7 further comprise handle flaps 141, 143 in the respective top end flaps 51, 53. In the illustrated embodiment, the handle flaps 141, 143 are defined by a respective tear line 145, 147 in a respective top end flap 51, 53, and the handle flaps are spaced apart from a respective longitudinal fold line 61, 63 and the top panel 23. Portions of the tear lines 145, 147, or all of the tear lines 145, 147, can be replaced by a cut line (e.g., the longitudinal portion of the tear lines 145, 147 could be a cut line). The article-receiving features further include article-receiving flaps 148, 149 foldably connected to each of the handle flaps 141, 143. The flaps 148, 149 can be defined by cut lines 150 and fold lines 152 extending to the respective tear lines 145, 147. The features that are for forming the handle 7 could be otherwise shaped, arranged, and positioned without departing from the disclosure.

In the illustrated embodiment, the blank 3 comprises features for forming a dispenser 151 of the carton 5. The features for forming the dispenser 151 include two spaced-apart longitudinal tear lines 157, 159 extending from the lateral fold line 73 across the side panel 15 and into the outer top panel 23 to a location adjacent to the outer handle panel 81. The dispenser 151 could be otherwise shaped, arranged, configured, and/or omitted without departing from the disclosure.

An exemplary method of erecting the carton 5 is discussed in detail below. At various stages in the erecting, respective portions of the blank 3 are mounted to one another in any suitable manner. For example, at various stages of the erecting process, glue or other adhesive material can be applied at various portions of the blank 3. For example, the adhesive material may be present where appropriate surfaces of the blank are in face-to-face contact. Depending upon the amount and/or type of adhesive material or other fastening mechanisms used, each of the face-to-face contacts described in the Detailed Description section of this disclosure may be more generally referred to as the respective features being in substantially face-to-face contact.

Figure 2:
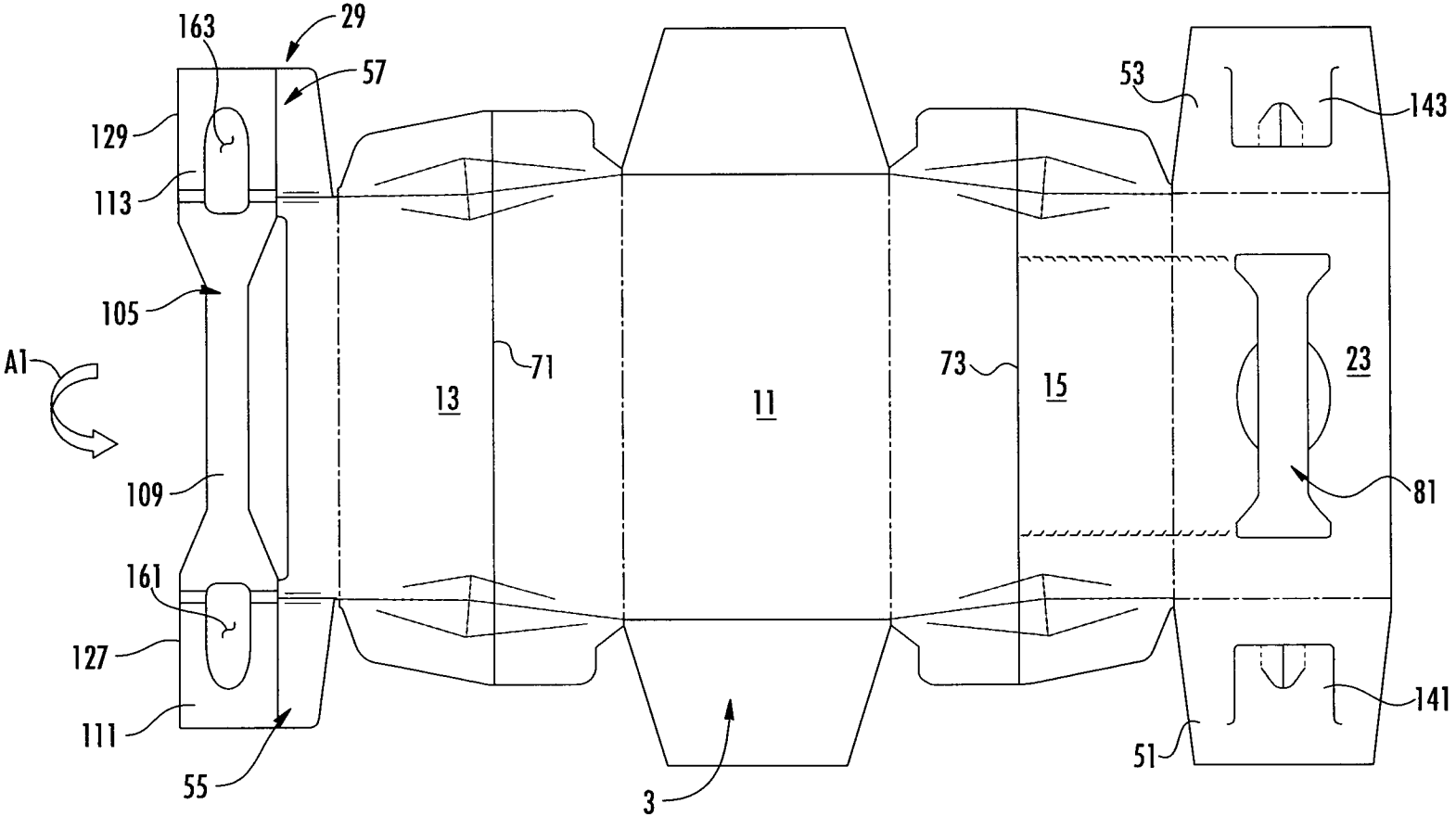
FIGS. 2-4 are views showing the erection of the blank of FIG. 1 into a carton according to the first embodiment of the disclosure.

As shown in FIG. 2, the blank 3 is first positioned with the exterior surface 1 facing down. First the inner handle panel 105 is folded about fold lines 127, 129 as indicated by arrow A1 so that the inner handle panel overlaps and is in face-to-face contact with the intermediate handle panel 107. Glue can be applied to portions of either the inner or intermediate handle panel 105, 107 to adhesively secure the inner and intermediate handle panels. When the inner and intermediate handle panels 105, 107 are overlapped, the openings 136, 138 in the respective end portions 111, 119 of the respective inner and intermediate handle panels 105, 107 are generally aligned and form an article-receiving opening 161, and the openings 137, 139 in the respective end portions 113, 121 of the respective inner and intermediate handle panels 105, 107 are generally aligned and form an article-receiving opening 163.

Figure 3:
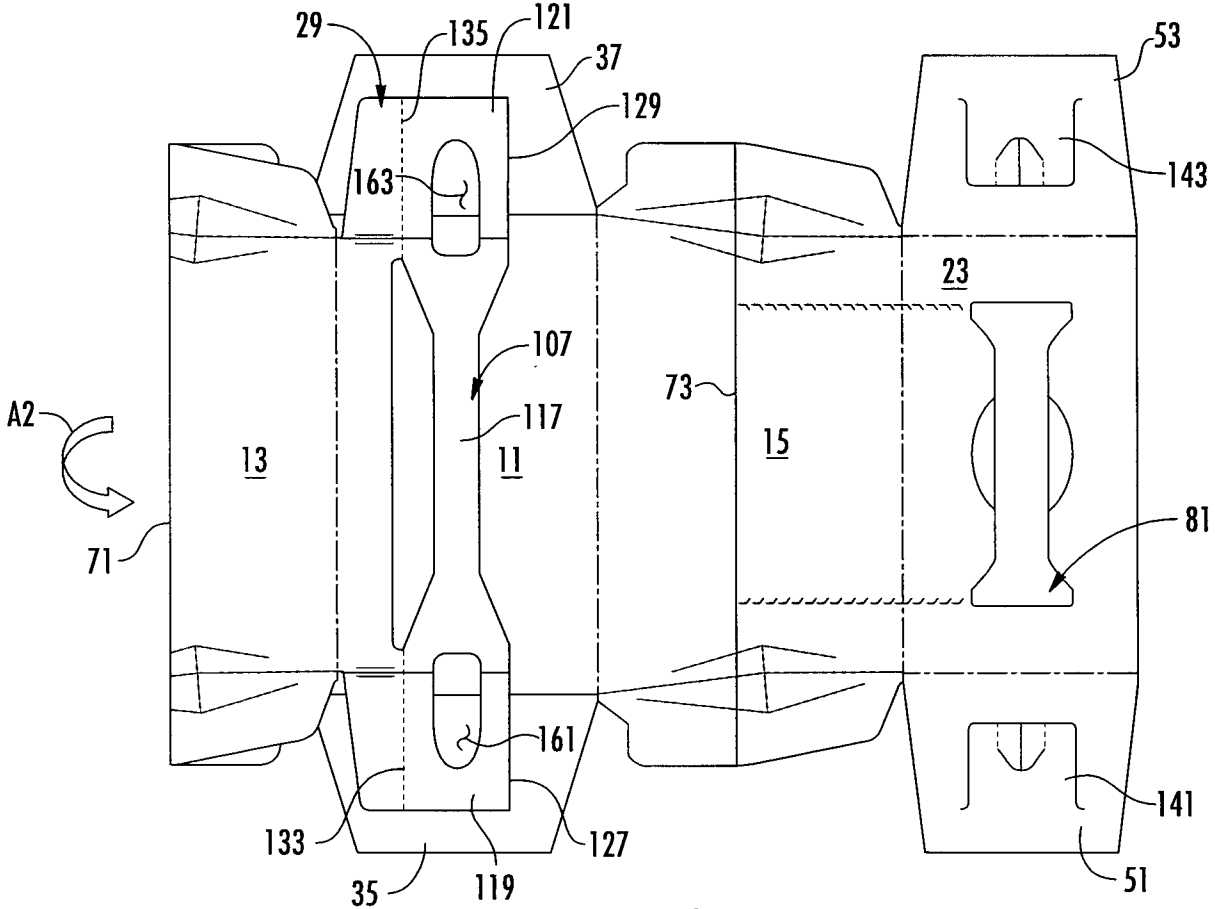

As shown in FIG. 3, the blank 3 can be folded at the lateral fold line 71 as indicated by arrow A2 to position the overlapped inner and intermediate handle panels 105, 107 to be in face-to-face contact with the bottom panel 11. Next, as shown in FIG. 4, the blank 3 is further assembled by folding at lateral fold line 73 as indicated by arrow A3 so that the outer top panel 23 overlaps the inner top panel 29 to form the top wall 30. In the position of FIG. 4, the outer handle panel 81 is in face-to-face contact with a portion of the intermediate handle panel 107 that overlaps the inner handle panel 105. Also, the handle flap 141 is in face-to-face contact with a portion of the end portion 119 of the intermediate handle panel 107, and the handle flap 143 is in face-to-face contact with a portion of the end portion 121 of the intermediate handle panel. In one embodiment, the outer handle panel 81 is adhesively secured to the central portion 117 of the intermediate handle panel 107, the handle flap 141 is adhesively secured to the end portion 119 of the intermediate handle panel 107, and the handle flap 143 is adhesively secured to the end portion 121 of the intermediate handle panel. The article-receiving features can be generally overlapped so that a portion of the article receiving-opening 161 is generally aligned with the article-receiving flaps 148, 149 in the handle flap 141 and a portion of the article-receiving opening 163 is generally aligned with the article-receiving flaps 148, 149 in the handle flap 143.

The partially assembled blank of FIG. 4 can be assembled into a open-ended sleeve so that containers C can be loaded into the sleeve. After loading the containers C, the ends 67, 69 of the carton can be closed by at least partially overlapping and adhering the end flaps 35, 41, 45, 51, 55 at one end of the carton and at least partially overlapping and adhering the end flaps 37, 43, 47, 53, 57 at the other end of the carton. The overlapped top end flaps at each end (e.g., 53, 57 at end 69) are downwardly folded and secured to the bottom end flap (e.g., 37) and side end flaps 43, 47 at the same end. The assembled carton 5 is shown in FIG. 5. The ends 67, 69 of the carton 5 could be closed by other closing steps and features without departing from the disclosure. Additionally, alternative closing and loading sequences may be used without departing from the disclosure. For example, the containers C can be loaded into the carton 5 after closing the first end 67 or the second end 69.

In the illustrated embodiment, at least the outer top panel 23 and the first top end flap 51 form a first upper corner 165, and the outer top panel 23 and the second top end flap 53 form a second upper corner 167. The inner top panel 29 and the third and fourth top end flaps 55, 57 are interior to the outer top panel 23 and the first and second top end flaps 51, 53. Accordingly, the upper corner 165 covers at least the end portions 111, 119 of the respective handle panels 105, 107, and the upper corner 167 covers at least the end portions 113, 121 of the respective handle panels 105, 107.

Figure 6:
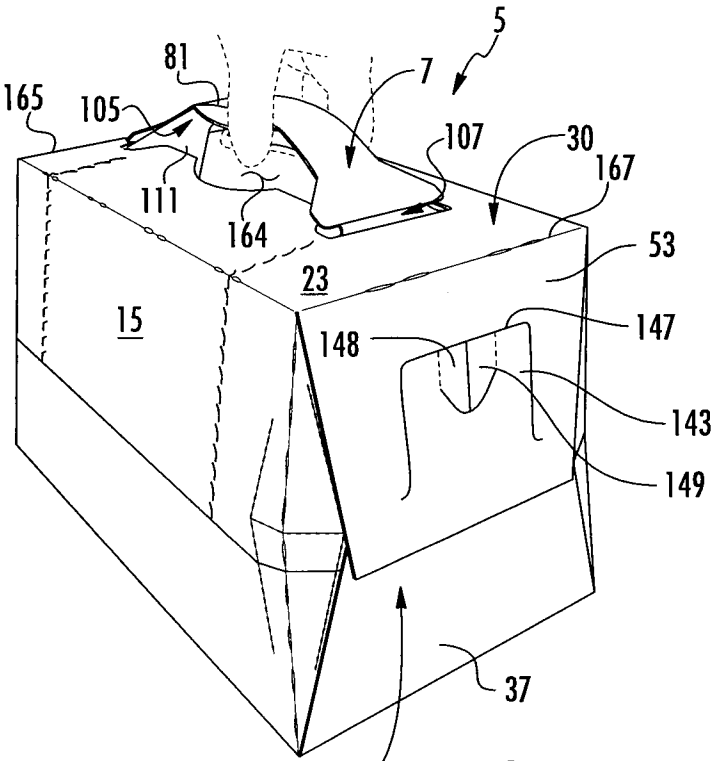
FIGS. 6 and 7 are a perspective views of the carton of FIG. 5 showing the activation of a handle according to the first embodiment of the disclosure.
Figure 7:
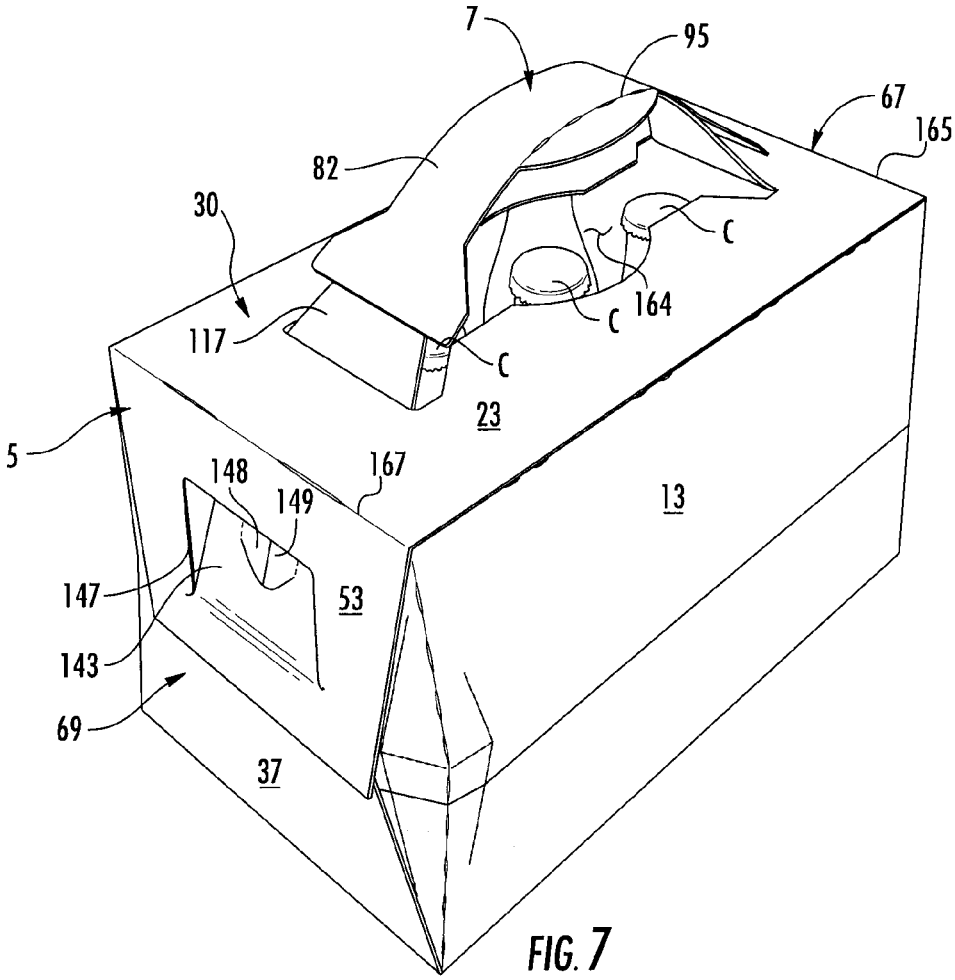
Figure 8:
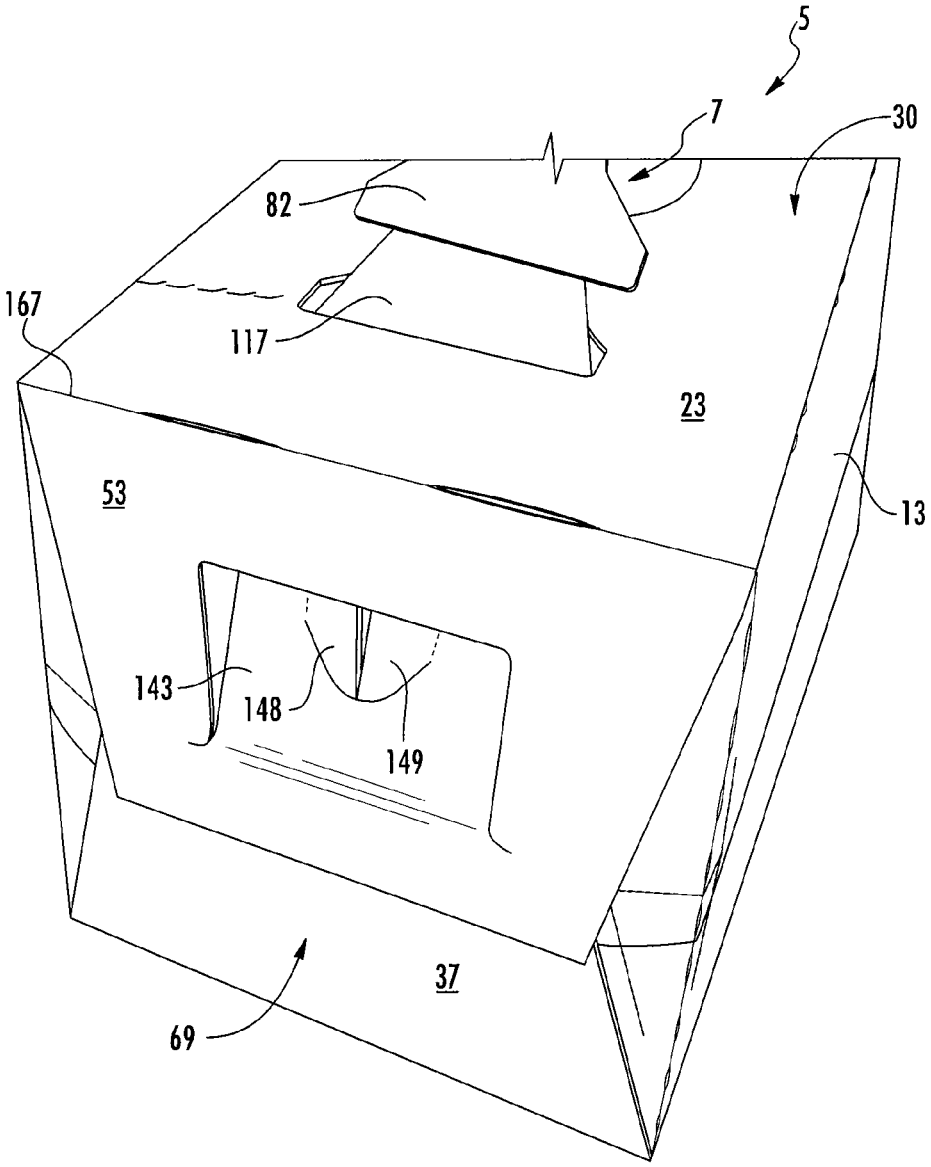
FIG. 8 is a perspective view of an end of the carton according to the first embodiment of the disclosure.

As shown in FIGS. 6 and 7, the handle 7 is activated by separating the outer handle panel 81 from the outer top panel 23 by tearing the tear line 87 to form an opening 164 in the top wall 30. The overlapped outer handle panel 81 and central portions 109, 117 of the inner and intermediate handle panels 105, 107 can be grasped and lifted upwardly as shown in FIGS. 6 and 7. The handle flaps 93 can be folded downwardly to underlap the central portions 109, 117, 81 of the respective handle panels 105, 107, 81 when separating the outer handle panel 81 from the outer top panel 23. By upwardly lifting the outer handle panel 81 and overlapped central portions 109, 117, the overlapped handle flap 141 and end portions 111, 119 at one end 67 and the overlapped handle flap 143 and end portions 113, 121 at the other end 69 are caused to fold inwardly toward the interior of the carton 5 as shown in FIGS. 7 and 8. The handle flaps 141, 143 separate from the respective top end flaps 51, 53 at a respective tear line 145, 147, the overlapped end portions 111, 119 separate from end flap 55 at tear line 133, and the overlapped end portions 113, 121 separate from end flap 57 at tear line 135.

In the illustrated embodiment, the handle 7 formed from the handle features of the blank comprises three layers of material (outer handle panel 81, central portion 117 of the intermediate handle panel 107, and central portion 109 of the inner handle panel 105) in the top of the carton 5, three layers of material (handle flap 141, end portion 119 of intermediate handle panel 107, and end portion 111 of inner handle panel 105) at the first end of the carton 67, and three layers of material (handle flap 143, end portion 121 of intermediate handle panel 107, and end portion 113 of inner handle panel 105) at the second end of the carton 69. The handle 7 could have other features and could include additional or fewer reinforcing layers or portions without departing from the disclosure.

It is noted that the handle 7 is formed in a manner that has end portions in the end 67, 69 of the carton 5 while keeping the corners of the carton at the ends 67, 69, including respective upper corners 165, 167, intact and free from any portion of the handle. The handle flaps 141, 143 are spaced apart from the top wall 30 so that the handle 7 extends in the carton 5 interior to the upper corners 165, 167 without disrupting the upper corners 165, 167. As shown in FIGS. 7 and 8, portions of the handle 7 are covered by the upper corners 165, 167. This feature allows the carton 5 to be grasped and carried at the handle 7 without sacrificing the strength and integrity of the carton at the closed ends 67, 69.

Figure 8A:
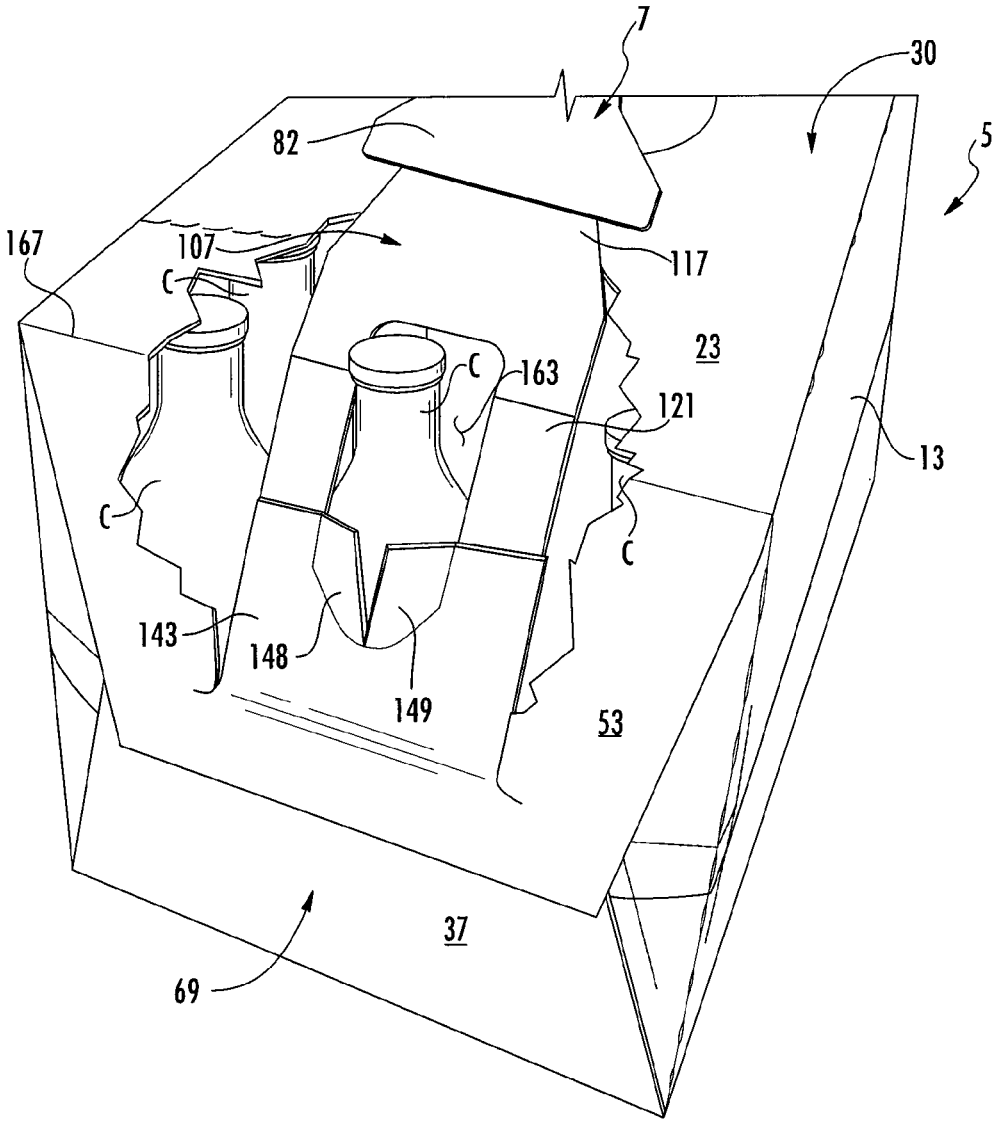
FIG. 8A is a partially cut-away perspective view of the end of the carton of FIG. 8.

In the illustrated embodiment, the article flaps 148, 149 in each of the handle flaps 141, 143 and the openings 161, 163 in the overlapped inner and intermediate handle panels 105, 107, allow the handle 7 to conform to or accommodate the end containers C that are adjacent a respective end 67, 69 of the carton 5 when the handle is lifted. As shown in FIG. 8A, one or more of the containers C adjacent or proximate the second end 69 can be received in the article-receiving opening 163 (the overlapped openings 136, 138 in the respective end portions 113, 121 of the respective handle panels 105, 107) when the handle 7 is activated. The article-receiving flaps 148, 149 in the handle flap 143 overlap a portion of the article-receiving opening 163 and are folded outwardly along fold lines 152 by the container as the opening 163 and the handle flap 143 move inwardly into the carton 5 when the handle 7 is lifted upwardly. The article-receiving opening 161 and article-receiving flaps 148, 149 of the handle flap 141 at the first end of the carton similarly can conform to or accommodate a container C. Accordingly, the handle 7 can be lifted upwardly relative to the top wall 30 and the ends of the handle can move inwardly from the ends 67, 69 of the carton 5 while accommodating the containers in the carton and without interrupting the upper corners 165, 167.

Figure 9:
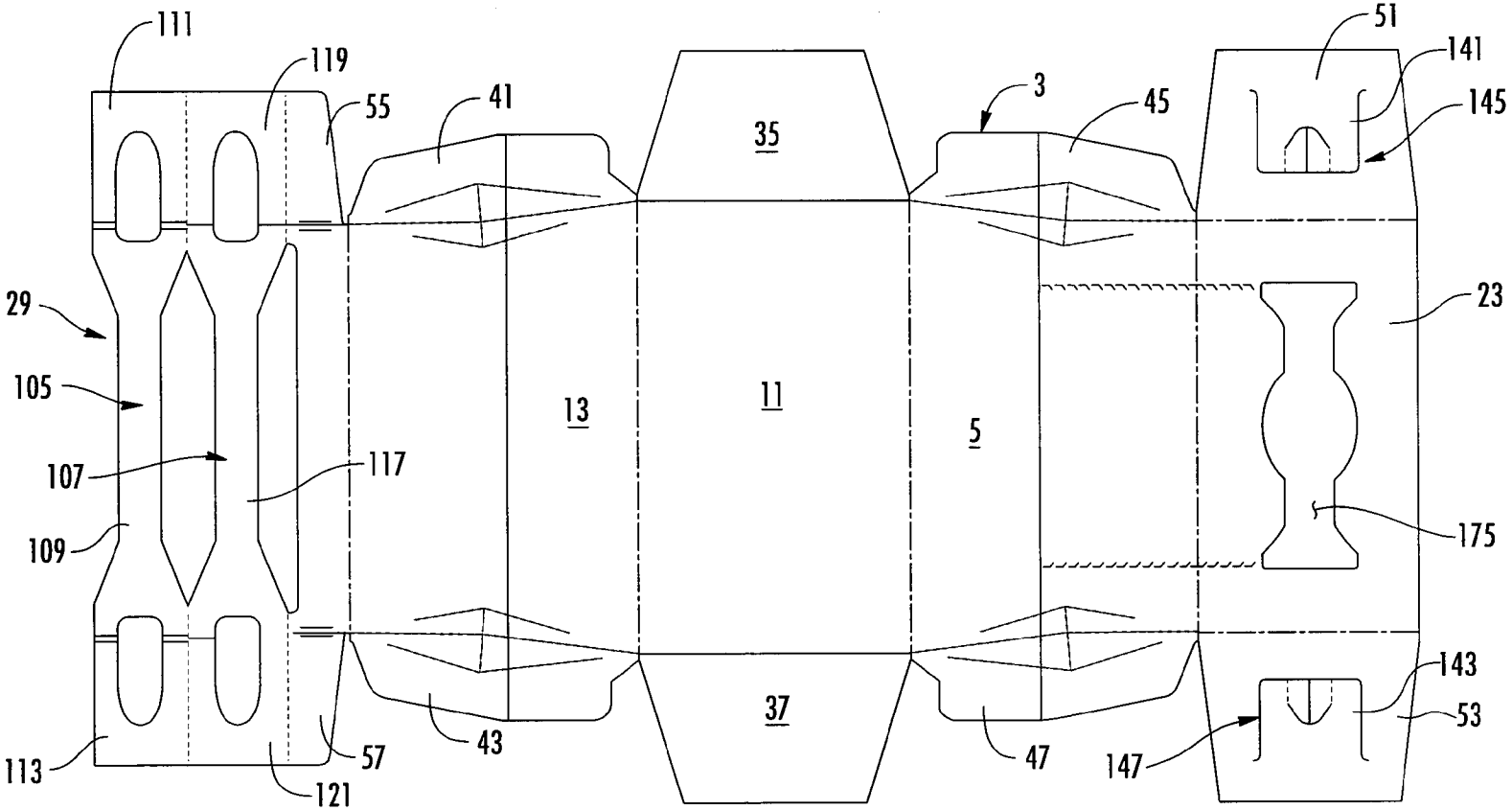
FIG. 9 is an exterior plan view of a blank for forming a carton according to a second embodiment of the disclosure.

FIG. 9 is a plan view of a second embodiment of a carton blank 3' that is similar to the first embodiment, with like or similar features having like or similar reference numbers. In the embodiment of FIG. 9, the top panel 23 includes an opening 175. The carton formed from the blank 3' of the second embodiment will comprises a handle 7 comprising two overlapped layers of the central portion 117 of the handle panel 107, and central portion 109 of the handle panel 105. In the second embodiment, the handle panel 107 is an outer handle panel, and the handle panel 105 is an inner handle panel and the handle features include the opening 175 in the top panel for receiving the overlapped central portions 117, 109 that can be upwardly lifted through the opening when the handle 7 is activated. The opening 175 could be alternatively shaped, arranged, and/or configured without departing from the disclosure.

Figure 10:
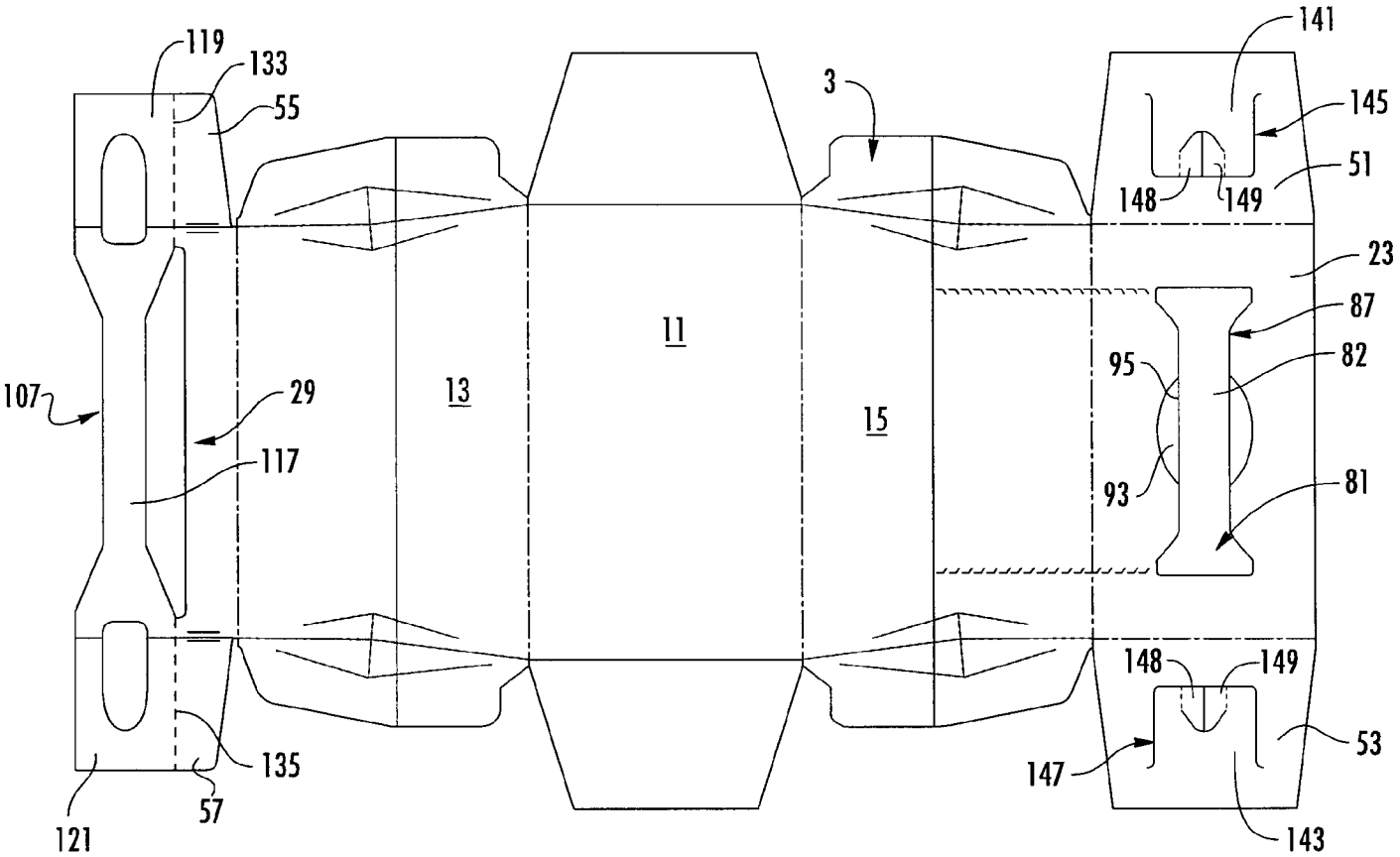
FIG. 10 is an exterior plan view of a blank for forming a carton according to a third embodiment of the disclosure.

FIG. 10 is a plan view of a third embodiment of the carton blank 3" that is similar to the first embodiment, with like or similar features having like or similar reference numbers. In the embodiment of FIG. 10, the handle panel 105 of the inner top panel 29 is eliminated and the handle 7 comprises two plies of material in the top of the carton that include the handle panel 107 in the inner top panel 29 and the handle panel 81 in the outer top panel 23. In the third embodiment, the handle panel 81 is an outer handle panel and the handle panel 107 is an inner handle panel that cooperate to form the handle 7 in a similar manner as the previous embodiments. The blank 3" could be otherwise shaped, arranged, and/or configured without departing from the disclosure.

In the embodiments of the disclosure comprising a two-ply handle panel, the caliper or thickness of the material of the blank can be increased to maintain the strength of the handle in the two-ply embodiments.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiments of this disclosure, a fold line can be any substantially linear, although not necessarily straight, form of weakening that facilitates folding therealong. More specifically, but not for the purpose of narrowing the scope of this disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue. The term "glue" is intended to encompass all manner of adhesives commonly used to secure carton panels or flaps in place.

The foregoing description of the disclosure illustrates and describes various exemplary embodiments. Various additions, modifications, changes, etc., could be made to the exemplary embodiments without departing from the spirit and scope of the invention as set forth in the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the claims, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising an inner top panel and an outer top panel that at least partially overlaps the inner top panel;

an outer end flap foldably connected to the outer top panel, the outer end flap at least partially closing an end of the carton; and a handle comprising a handle panel defined in at least the inner top panel and a handle flap defined in the outer end flap, wherein the handle panel comprises a central portion and an end portion foldably connected to the central portion, at least a portion of the end portion of the handle panel being in substantially face-to-face contact with at least a portion of the handle flap; and at least a portion of the handle flap being defined by a tear line extending in the outer end flap.

2. The carton of claim 1, wherein:

the handle further comprises article-receiving features extending in at least one of the end portion of the handle panel and the handle flap, the article-receiving features being for receiving at least a portion of at least one article of the plurality of articles.

3. The carton of claim 2, wherein:

the article-receiving features comprise an article-receiving opening extending in the end portion of the handle panel and at least two article-receiving flaps foldably connected to the handle flap; and the article-receiving flaps of the handle flap are generally aligned with the article-receiving opening in the end portion of the handle panel.

4. The carton of claim 2, wherein:

the handle panel is a first handle panel, the central portion is a first central portion, and the end portion is a first end portion;

the handle further comprises a second handle panel extending in at least the top panel, the second handle panel comprising a second central portion and a second end portion foldably connected to the second central portion;

at least a portion of the second handle panel is in substantially face-to-face contact with at least a portion of the first handle panel; and the first end portion is foldably connected to the second end portion.

5. The carton of claim 1, wherein the handle further comprises an outer handle panel extending in the outer top panel, at least a portion of the outer handle panel being in substantially face-to-face contact with at least a portion of the handle panel in the inner top panel.

6. A carton for containing a plurality of articles, the carton comprising:

a plurality of panels that extends at least partially around an interior of the carton, the plurality of panels comprising an inner top panel, an outer top panel, at least a portion of the outer top panel defining at least a portion of a top wall of the carton;

an end flap foldably connected to at least one panel of the plurality of panels, the end flap at least partially closing an end of the carton, the end flap comprises a top end flap foldably connected to the outer top panel;

a handle comprising a handle panel extending in at least the inner top panel and a handle flap extending in at least the top end flap, wherein the handle panel is mounted to the handle flap, and the handle flap is circumscribed by a remainder of the top end flap and spaced apart from the top wall of the carton; and at least a portion of the handle flap being defined by a tear line extending in the top end flap.

7. The carton of claim 6, wherein the handle panel comprises a central portion and an end portion foldably connected to the central portion, at least a portion of the end portion of the handle panel being in substantially face-to-face contact with at least a portion of the handle flap.

8. The carton of claim 7, wherein:

the end portion of the handle panel is secured to an interior surface of the handle flap;

the handle further comprises article-receiving features extending in at least one of the end portion of the handle panel and the handle flap, the article-receiving features being for receiving at least a portion of at least one article of the plurality of articles.

9. The carton of claim 8, wherein:

the article-receiving features comprise an article-receiving opening extending in the end portion of the handle panel and at least two article-receiving flaps foldably connected to the handle flap; and the article-receiving flaps of the handle flap are generally aligned with the article-receiving opening in the end portion of the handle panel.

10. The carton of claim 7, wherein:

the handle panel is a first handle panel, the central portion is a first central portion, and the end portion is a first end portion;

the handle further comprises a second handle panel extending in at least the inner top panel, the second handle panel comprising a second central portion and a second end portion foldably connected to the second central portion; and at least a portion of the second handle panel is in substantially face-to-face contact with at least a portion of the first handle panel.

11. The carton of claim 10, wherein:

the first end portion is in substantially face-to-face contact with the second end portion;

each of the first end portion and the second end portion comprising an article-receiving opening, the article-receiving opening of the first end portion being generally aligned with the article-receiving opening of the second end portion;

the article-receiving openings are for receiving at least a portion of an article of the plurality of articles.

12. The carton of claim 10, wherein:

at least a portion of the outer top panel overlaps at least a portion of the inner top panel, the top wall further comprising at least a portion of the outer top panel.

13. The carton of claim 12, wherein:

at least a portion of the first handle panel is connected to the inner top panel along a first tear line;

at least a portion of the handle flap is connected to the top end flap along a second tear line; and the handle further comprises an outer handle panel connected to the outer top panel along a third tear line, the outer handle panel being in substantially face-to-face contact with an exterior surface of at least the first central portion of the first handle panel.

14. The carton of claim 13, wherein at least the outer top panel and the top end flap form an upper corner at the end of the carton, wherein the upper corner is disposed between at least a portion of the second tear line and the third tear line, and the upper corner remains intact when the handle is activated.

15. The carton of claim 6, wherein:

the plurality of panels further comprises a first side panel and a second side panel;

the inner top panel is foldably connected to the first side panel, and the outer top panel is foldably connected to the second side panel.

16. The carton of claim 15, wherein at least the outer top panel and the end flap form an upper corner at the end of the carton, wherein the handle is disposed inwardly of the upper corner, and the upper corner remains intact when the handle is activated.

17. The carton of claim 15, wherein the handle further comprises an outer handle panel extending in the outer top panel, at least a portion of the outer handle panel being in substantially face-to-face contact with at least a portion of the handle panel in the inner top panel.

18. The carton of claim 15, wherein the handle panel comprises a central portion and an end portion foldably connected to the central portion, at least a portion of the end portion of the handle panel being in substantially face-to-face contact with at least a portion of the handle flap.

19. The carton of claim 18, wherein:

the carton further comprises a first side end flap foldably connected to the first side panel and a second side end flap foldably connected to the second side panel.

20. The carton of claim 18, wherein:

the end portion of the handle panel is secured to an interior surface of the handle flap;

the end portion of the handle panel defines an article-receiving opening for receiving at least a portion of at least one article of the plurality of articles; and the handle flap comprising at least two article-receiving flaps for engaging at least one article of the plurality of articles, the at least two article-receiving flaps being generally aligned with the article-receiving opening in the end portion of the handle panel.

21. The carton of claim 20, wherein:

the end flap comprises a first end flap, the end of the carton comprises a first end of the carton, and the handle flap comprises a first handle flap;

the carton further comprises a second end flap foldably connected to at least one panel of the plurality of panels, the end flap at least partially closing a second end of the carton; and the carton further comprises a second handle flap extending in at least the second end flap, the second handle flap is spaced apart from the inner top panel and the outer top panel.

22. The carton of claim 21, wherein:

the end portion of the handle panel comprises a first end portion, and the handle panel further comprises a second end portion foldably connected to the central portion opposite to the first end portion; and the second end portion of the handle panel is secured to an interior surface of the second handle flap.

23. The carton of claim 15, wherein:

the handle panel is a first handle panel, and the handle further comprises a second handle panel extending in at least the inner top panel; and at least a portion of the second handle panel is in substantially face-to-face contact with at least a portion of the first handle panel.

24. A blank for forming a carton for containing a plurality of articles, the blank comprising:

a plurality of panels comprising an inner top panel, an outer top panel;

a top end flap foldably connected to the outer top panel;

a handle comprising a first handle panel and a second handle panel extending in at least the inner top panel and a handle flap extending in the top end flap, wherein the first handle panel comprises a central portion and an end portion foldably connected to the central portion, and the handle flap is circumscribed by a remainder of the top end flap and spaced apart from the plurality of panels, the handle further comprises an outer handle panel extending in the outer top panel;

at least a portion of the first handle panel is foldably connected to at least a portion of the second handle panel;

at least a portion of the first handle panel is connected to the inner top panel along a first tear line at least a portion of the handle flap is connected to the top end flap along a second tear line; and the outer handle panel is connected to the outer top panel along a third tear line.

25. The blank of claim 24, wherein at least a portion of the central portion of the first handle panel comprises a first width, at least a portion of the end portion of the first handle panel comprises a second width, and the first width is less than the second width.

26. The blank of claim 24, wherein the handle further comprises article-receiving features extending in at least one of the handle flap and the end portion of the first handle panel, the article-receiving features being for receiving at least a portion of at least one article of the plurality of articles.

27. The blank of claim 26, wherein the article-receiving features comprise an article-receiving opening extending in the end portion of the second handle panel and at least two article-receiving flaps foldably connected to the handle flap.

* * * * *